US011851790B2

(12) United States Patent
Milicevic et al.

(10) Patent No.: US 11,851,790 B2
(45) Date of Patent: Dec. 26, 2023

(54) KNITTING NEEDLE

(71) Applicant: Groz-Beckert KG, Albstadt (DE)

(72) Inventors: Ante Milicevic, Sindelfingen (DE); Juergen Schick, Bitz (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 17/160,978

(22) Filed: Jan. 28, 2021

(65) Prior Publication Data

US 2021/0230778 A1 Jul. 29, 2021

(30) Foreign Application Priority Data

Jan. 28, 2020 (EP) ..... 20154212

(51) Int. Cl.
*D04B 3/02* (2006.01)

(52) U.S. Cl.
CPC ..... *D04B 3/02* (2013.01)

(58) Field of Classification Search
CPC ..... D04B 3/02; D04B 33/00; D04B 35/02; D04B 35/06; D04B 35/08; D05B 85/00; D04H 18/02; B42B 2/04
USPC ..... 66/116, 117, 118
See application file for complete search history.

(56) References Cited

U.S. PATENT DOCUMENTS 2,854,836 A * 10/1958 Morris ..... D04B 35/02 66/119
3,229,485 A * 1/1966 Peschl ..... D04B 35/06 66/120
3,309,900 A * 3/1967 Wunsch ..... D04B 27/08 112/80.52
7,874,182 B1 * 1/2011 Lindahl ..... D04B 3/02 66/118
2005/0016221 A1 * 1/2005 Bruske ..... D04B 35/02 66/116
2008/0173046 A1 * 7/2008 Bausch ..... D04B 35/04 66/121
2010/0050698 A1 * 3/2010 Weber ..... D04B 35/04 66/121

FOREIGN PATENT DOCUMENTS

DE 4038936 A1 * 6/1991 ..... D04B 35/06
DE 4038936 A1 6/1991
DE 4206842 A1 * 9/1993 ..... B21G 1/06
DE 4344375 C1 * 1/1995 ..... D04B 35/06
EP 1500734 A1 1/2005
EP 1887122 A1 2/2008

OTHER PUBLICATIONS

European Patent Office; Search Report in related European Patent Application No. 20 154 212.3 dated Aug. 7, 2020; 10 pages.

* cited by examiner

*Primary Examiner* — Aiying Zhao
(74) *Attorney, Agent, or Firm* — Dorton & Willis, LLP

(57) ABSTRACT

A knitting needle includes a hook point having an upper face, lateral portions, and a rear portion. The knitting needle has an at least approximately oval cross section, at least in portions, at the hook point, in order to improve the knitting needle in terms of structure and/or function.

16 Claims, 4 Drawing Sheets

KNITTING NEEDLE

CROSS-REFERENCE TO RELATED APPLICATIONS

This application claims the benefit of priority under 35 U.S.C. § 119(a) to European Patent Application EP 20 154 212.3, filed Jan. 28, 2020 (pending), the disclosure of which is incorporated by reference in its entirety.

TECHNICAL FIELD

The invention relates generally to knitting apparatus and, more particularly, to a knitting needle comprising a hook point having an upper face, lateral portions, and a rear portion.

BACKGROUND

DE 40 38 936 A1 relates to a slide needle for warp knitting machines, in particular stitch bonding machines, comprising an asymmetrical needle head and a point which is provided on the head, above the central longitudinal axis of the needle, the needle head comprising a lower wedge surface which is oriented obliquely from the needle point to the needle back, and an upper wedge surface, and adjoins a thread chamber, and a portion of the upper wedge surface, which extends in parallel with the central longitudinal axis and faces the thread chamber, functions as a guide surface for the front part of a slide, the thread chamber furthermore comprising a base which is located significantly below the needle point plane and is separated from the lower wedge surface or the needle back by a small cross section. According to DE 40 38 936 A1, an oblique surface is arranged between a front end of the guide surface for the front part of the slide and the needle point, such that the needle point is closer to the central longitudinal axis than the guide surface is, the oblique surface and the guide surface are at a DELTA angle relative to one another, which angle is from 3 to 10 degrees, and the position of the needle point has such a relationship to the guide surface, since an imaginary line in parallel with the guide surface and leading through the needle point is at a very small distance from the guide surface.

A knitting needle is known from EP 1 500 734 A1, which needle is intended in particular for stitch bonding technology, in particular for technical materials, comprising an elongate needle body, which comprises a recess for receiving a thread, and a retaining device at one end, as well as a pointed end on the opposing side, and two flat sides which taper towards one another, at an acute angle, towards the end, the acute angle having a first value, following the end, which changes to a lower value at a transition point remote from the end. According to EP 1 500 734 A1 it is proposed that the needle body should comprise a needle upper lateral surface and a needle lower lateral surface which intersect at the end, that the needle body should have a rectangular cross section, and that the end of the needle body should be located on a center line which extends in parallel with the longitudinal extension of the needle body and intersects the recess substantially at half the depth.

The object of the invention is that of improving a knitting needle mentioned at the outset, in terms of structure and/or function.

SUMMARY

The object is achieved by a knitting needle as shown and described herein.

The knitting needle can be used in a stitch bonding method. The knitting needle may be a stitch bonding needle. The knitting needle may be used together with a warp knitting machine. The knitting needle can be used in a knitting method in which, during a vertical lifting movement in a knitting needle longitudinal direction, the knitting needle is additionally moved horizontally in a production direction transverse to the knitting needle longitudinal direction. The knitting needle can be used for producing technical textiles. The knitting needle can be used for producing reinforcing textiles for fiber-reinforced materials. The knitting needle can be used for producing textiles from inorganic fibers, such as basalt fibers, boron fibers, glass fibers, ceramic fibers, silica fibers, carbon fibers, quartz fibers, metal fibers and/or steel fibers, and/or from organic fibers, such as aramid fibers, carbon fibers, PBO fibers, polyester fibers, nylon fibers, polyethylene fibers, and/or polymethylmethacrylate fibers.

The knitting needle can comprise a longitudinal axis, a vertical axis, and a transverse axis, which axes are arranged so as to be at right angles to one another. The longitudinal axis, the vertical axis, and the transverse axis can form a cartesian coordinate system. The longitudinal axis can extend in a top half of a cross section of the needle shank. The longitudinal axis can extend at least approximately centrally, in a cross section of the needle shank. The longitudinal axis can extend along an upper face of the hook point.

The hook point can form a front part of the knitting needle. The hook point can comprise a point portion and a hook portion. The point portion can form a front end of the knitting needle. The hook portion can adjoin the point portion, in the extension direction of the longitudinal axis. The hook portion can comprise a hook protrusion. The hook portion can comprise a hook throat and/or a hook base.

The upper face can form an upper face of the knitting needle. The upper face can be oriented in the extension direction of the vertical axis. The rear portion can form a lower face of the knitting needle. The rear portion can be oriented in the extension direction of the vertical axis. The upper face and the rear face can be oriented in a mutually opposing manner. The lateral portions can be oriented in the extension direction of the transverse axis. The lateral portions can be oriented in a mutually opposing manner.

The knitting needle can comprise a needle shank. The needle shank can form a central or rear part of the knitting needle. The needle shank can adjoin the hook point, in the extension direction of the longitudinal axis.

The knitting needle can comprise a slit. The slit can extend in the extension direction of the longitudinal axis. The slit can be arranged on the needle shank. The slit can be used for guiding a slide. The slit can be used for guiding a slide in the extension direction of the longitudinal axis. The slit can be used for guiding a slide, in order to open and/or close the hook throat. The slit can be arranged in the lengthening of the hook protrusion, in the extension direction of the longitudinal axis. The knitting needle may be a slide needle.

The cross section may be a cross sectional surface. The cross section can be in a plane spanned by the vertical axis and the transverse axis, or in a plane in parallel therewith. The cross section can be in a plane at right angles to the longitudinal axis. The knitting needle may have an at least approximately oval cross section, at least in portions, at the point portion and/or at the hook portion. The knitting needle may have an at least approximately oval cross section at the hook point, in particular at the point portion and/or at the hook portion, on the upper face and/or on the rear portion face. The knitting needle may have a semi-oval, in particular half-oval, cross section at the hook point, in particular at the point portion and/or at the hook portion. A semi-oval, in particular half-oval, cross section of the knitting needle may be limited by the hook throat and/or by the hook base.

The knitting needle may have an at least approximately oval cross section at the hook point, in particular at the point portion and/or at the hook portion, on the upper face and/or on the rear portion face. The knitting needle may have an at least approximately semi-oval, in particular at least approximately half-oval, cross section at the hook point, in particular at the point portion and/or at the hook portion. An at least approximately semi-oval, in particular approximately half-oval, cross section of the knitting needle may be limited by the hook throat and/or by the hook base.

The cross section which is at least approximately oval or at least approximately semi-oval, at least in portions, may be symmetrical to the vertical axis and/or to the transverse axis. The cross section which is at least approximately oval or at least approximately semi-oval, at least in portions, may be elliptical. The cross section which is at least approximately oval or at least approximately semi-oval, at least in portions, may be elliptical, the vertical axis forming a major axis, and the transverse axis forming a minor axis.

The cross section can be round, at least in portions. The cross section can be designed in the shape of an obtuse-angled polygon, at least in portions. The at least approximately oval cross section can be hendecahedral or dodecahedral, at least in portions. The at least approximately semi-oval cross section can be pentagonal or hexagonal, at least in portions.

Corners of the cross section can form edges, over a longitudinal cross section of the knitting needle. Edges on the upper face can extend so as to be at least approximately in parallel with the longitudinal axis. Edges on the rear portion face can extend downwards proceeding form the point portion, sloping towards the hook portion, sloping towards the rear portion.

The knitting needle may comprise a planar cover surface on the upper face of the hook point. The cover surface can be arranged so as to be at least approximately in parallel with a plane spanned by the longitudinal axis and the transverse axis. The knitting needle may comprise oblique edge surfaces on the upper face of the hook point. The edge surfaces may be arranged so as to be at least approximately in parallel with the longitudinal axis and oblique to the transverse axis. The edge surfaces may adjoin the cover surface. The edge surfaces may directly adjoin one another. The cover surface and/or the edge surfaces can extend as far as the hook portion, proceeding from the point portion, in particular as far as the hook protrusion. The edge surfaces can enclose an angle of from approximately 80 degrees to approximately 100 degrees, in particular approximately 90 degrees, an angle of from approximately 65 degrees to approximately 85 degrees, in particular approximately 75 degrees, and/or an angle of from approximately 50 degrees to approximately 70 degrees, in particular approximately 60 degrees. The angle can be selected depending on a dimension of the needle in the extension direction of the transverse axis. The smaller the dimension of the needle in the extension direction of the transverse axis, the smaller it is possible to select the angle. The larger the dimension of the needle in the extension direction of the transverse axis, the larger it is possible to select the angle. On the upper face of the hook point, the knitting needle can comprise oblique first edge surfaces which adjoin the cover surface, and oblique second edge surfaces which adjoin the first edge surfaces. The first edge surfaces can enclose an angle of from approximately 80 degrees to approximately 100 degrees, in particular approximately 90 degrees, at the upper face, and the second edge faces can enclose an angle of from approximately 50 degrees to approximately 70 degrees, in particular approximately 60 degrees, at the upper face.

The knitting needle can comprise a flat cover surface at the rear portion of the hook point. The cover surface can be arranged so as to be at least in parallel with a plane spanned by the longitudinal axis and the transverse axis. The knitting needle can comprise oblique edge surfaces at the rear portion of the hook point. The edge surfaces can be arranged so as to be at least approximately in parallel with the longitudinal axis and oblique to the transverse axis. The edge surfaces can directly adjoin one another. The edge surfaces may adjoin the cover surface. The cover surface and/or the edge surfaces can extend as far as the hook portion, in particular as far as the hook protrusion, proceeding from the point portion. The edge surfaces can enclose an angle of from approximately 110 degrees to approximately 130 degrees, in particular approximately 120 degrees, an angle of from approximately 80 degrees to approximately 100 degrees, in particular approximately 90 degrees, and/or an angle of from approximately 50 degrees to approximately 70 degrees, in particular approximately degrees, at the rear portion. At the rear portion of the hook point, the knitting needle can comprise oblique edge surfaces which adjoin the cover surface, and oblique second edge surfaces that adjoin the first edge surfaces. The first edge surfaces can enclose an angle of from approximately 110 degrees to approximately 130 degrees, in particular approximately 120 degrees, an angle of from approximately 80 degrees to approximately 100 degrees, in particular approximately 90 degrees, at the rear portion, and the second edge surfaces can enclose an angle of from approximately 50 degrees to approximately 70 degrees, in particularly approximately 60 degrees, at the rear portion.

The knitting needle can have an overall height at the hook point. The overall height can extend in an extension direction of the vertical axis. The upper edge surfaces can include a portion of from approximately 20 percent to approximately 40 percent, in particular of approximately 30 percent, of the overall height. The lateral portions can include a portion of from approximately 20 percent to approximately 40 percent, in particular approximately 30 percent, of the overall height. The rear portion edge surfaces can include a portion of from approximately 20 percent to approximately percent, in particular approximately 30 percent, of the overall height.

The lateral portions of the knitting needle can converge at the point portion and/or at the hook protrusion. The lateral portions of the knitting needle can converge at the point portion and/or at the hook protrusion, in a viewing direction which corresponds to the extension direction of the vertical axis. The lateral portions of the knitting needle can converge in an oval, semi-oval, or polygonal manner. The lateral portions of the knitting needle can converge in the manner of a step wedge, at the point portion and/or at the hook protrusion. The lateral portions of the knitting needle can converge with a first step and a second step. The second step may be arranged so as to be closer to the point portion than the first step is. The first step may be arranged on the point portion side of the slit. The first step may be arranged so as to be spaced apart from the slit, in the direction of the point portion. The second step may be arranged on the point portion side of the hook protrusion. The second step may be arranged between the point portion and the hook protrusion.

The second step may be arranged at least approximately centrally, between the point portion and the hook protrusion. The lateral portions of the knitting needle may converge, at the first step, at an angle of from approximately 4 degrees to approximately 10 degrees, in particular approximately 7 degrees. The lateral portions of the knitting needle can converge at the second step, at an angle of from approximately 20 degrees to approximately 30 degrees, in particular approximately 25 degrees. The angle can be selected depending on a dimension of the needle in the extension direction of the transverse axis. The smaller the dimension of the needle in the extension direction of the transverse axis, the smaller it is possible to select the angle. The larger a dimension of the needle in the extension direction of the transverse axis, the larger the angle can be selected.

The upper face and the rear portion can converge at the point portion and/or at the hook portion. The lateral portions of the knitting needle can converge at the point portion and/or at the hook protrusion, in a viewing direction that corresponds to the extension direction of the transverse axis. The lateral portions of the knitting needle can converge in an oval, semi-oval or polygonal manner. The upper face and the rear portion can converge at the point portion and/or at the hook portion in the manner of a step wedge.

The upper face can extend along the longitudinal axis. The cover surface can extend along the longitudinal axis. The upper face can be arranged on the rear portion of the longitudinal axis. The point portion can be located on the longitudinal axis. The point portion can be asymmetrical to the longitudinal axis. The point portion can be arranged largely on the rear portion side of the longitudinal axis. The point portion can be arranged at least approximately completely on the rear portion side of the longitudinal axis.

In summary and in other words, the invention thus results inter alia in a slide needle for warp knitting machines, in particular stitch bonding machines, having an optimized point head. The needle may have a head shape having an elliptical cross section. A point head cross section can be at least approximately elliptical in shape. For this purpose, a crosspiece can be designed so as to be relatively narrow. The crosspiece can also be referred to as the cover surface. It is possible for at least two cover edge chamfers to be provided. The cover edge chamfers can also be referred to as edge surfaces. The cover edge chamfers can extend over the entire point head length. Furthermore, a step-shaped wedge shape can be created, in a plan view, by means of at least one taper. Furthermore, the elliptical shape of the point head can be provided not only in cross section, but also in a side view and in plan view.

The invention increases the ability for absorbing radial forces. Furthermore, wear on the needle, and damage to a material to be processed, is reduced. More planar looping of the point head is made possible, and a non-woven fabric/fibers can be better laid around the point head. Improved looping, without significant deflection, results in the radial force being absorbed more uniformly by the point head. Furthermore, a smaller deflection reduces punctual loading of the point head, and prevents the occurrence of wear notches. A contact surface of the needle is reduced, and a more uniform distribution of force in the needle body is brought about. It is thereby possible to achieve further advantages with respect to the radial and axial force.

BRIEF DESCRIPTION OF THE DRAWINGS

The accompanying drawings, which are incorporated in and constitute a part of this specification, illustrate exemplary embodiments of the invention and, together with a general description of the invention given above, and the detailed description given below, serve to explain the principles of the present invention.

DETAILED DESCRIPTION

Figure 1:
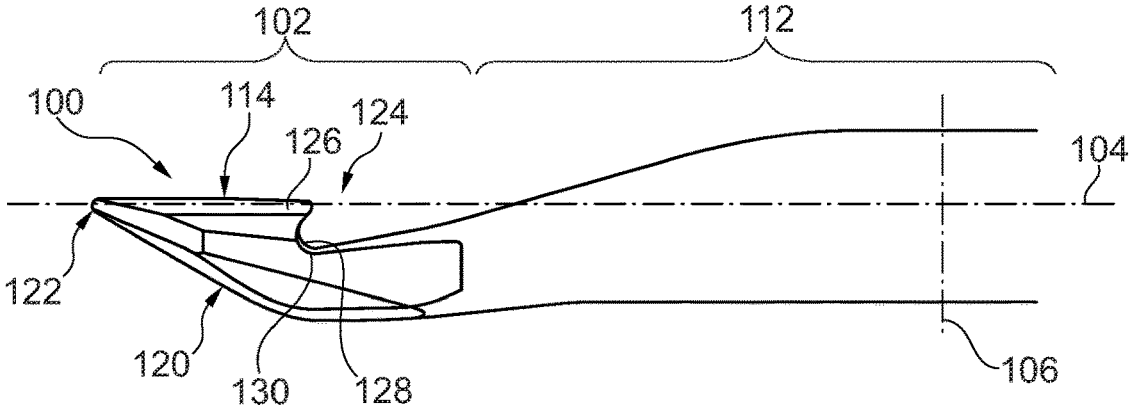
FIG. 1 is a side view of a knitting needle comprising a hook point and having an approximately oval cross section at the hook point.
Figure 2:
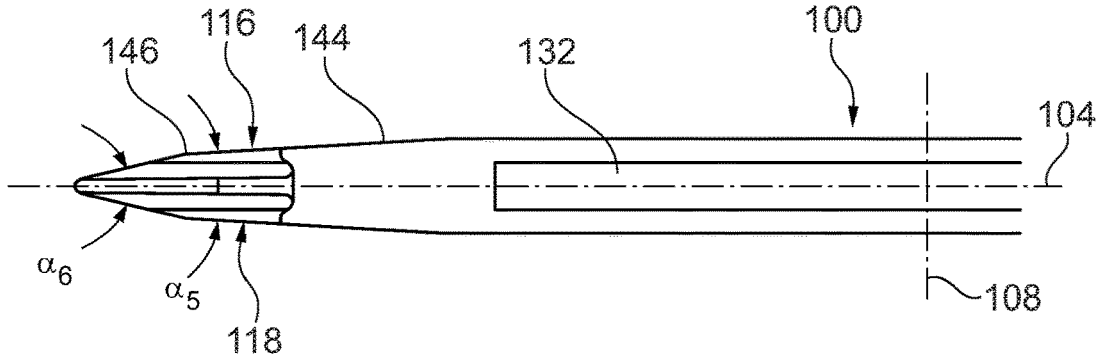
FIG. 2 is a plan view of a knitting needle comprising a hook point and having an approximately oval cross section at the hook point.

FIG. 1 is a detail side view of a knitting needle 100 comprising a hook point 102 and having an approximately oval cross section at the hook point 102. FIG. 2 is a plan view of the knitting needle 100.

The knitting needle 100 is intended for use in a stitch bonding method. The knitting needle 100 has a longitudinal axis 104, a vertical axis 106, and a transverse axis 108, which are arranged so as to be at right angles to one another.

The hook point 102 forms a front part of the knitting needle 100. The hook point 102 comprises an upper face 114 which is oriented in the extension direction of the vertical axis 106 and extends along the longitudinal axis 104, lateral portions 116, 118 which are oriented in the extension direction of the transverse axis 108, and a rear portion 120 which is oriented in the extension direction of the vertical axis 106 and forms a lower face of the knitting needle 100. The hook point 102 comprises a point portion 122 and a hook portion 124. The point portion 122 is located asymmetrically to the longitudinal axis 104 and forms a front end of the knitting needle 100. The hook portion 124 adjoins the point portion 122 in the extension direction of the longitudinal axis 104. The hook portion 124 comprises a hook protrusion 126, a hook throat 128, and a hook base 130. The hook throat 128 extends from the hook protrusion 126 in a direction toward the rear portion 120 and terminates in the hook base 130.

The knitting needle 100 comprises a needle shank 112. The needle shank 112 adjoins the hook point 102 in the extension direction of the longitudinal axis 104, and forms a central or rear part of the knitting needle 100. The knitting needle 100 comprises a slit 132 which is arranged on the needle shank 112 and extends in the extension direction of the longitudinal axis 104. The slit 132 is used for guiding a slide in the extension direction of the longitudinal axis 104, in order to open and/or close the hook throat 128.

Figure 3:
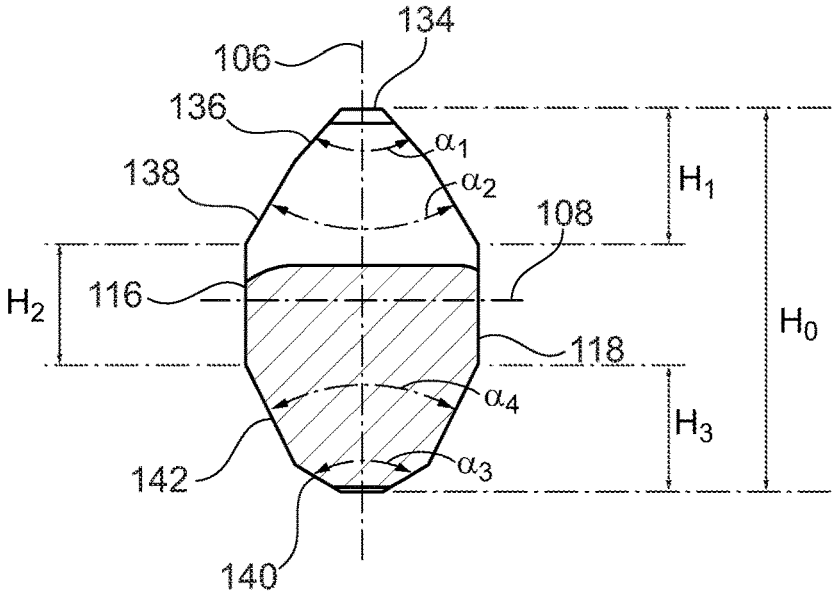
FIG. 3 is an enlarged cross section of a knitting needle comprising a hook point and having an approximately oval cross section at the hook point.
Figure 4:
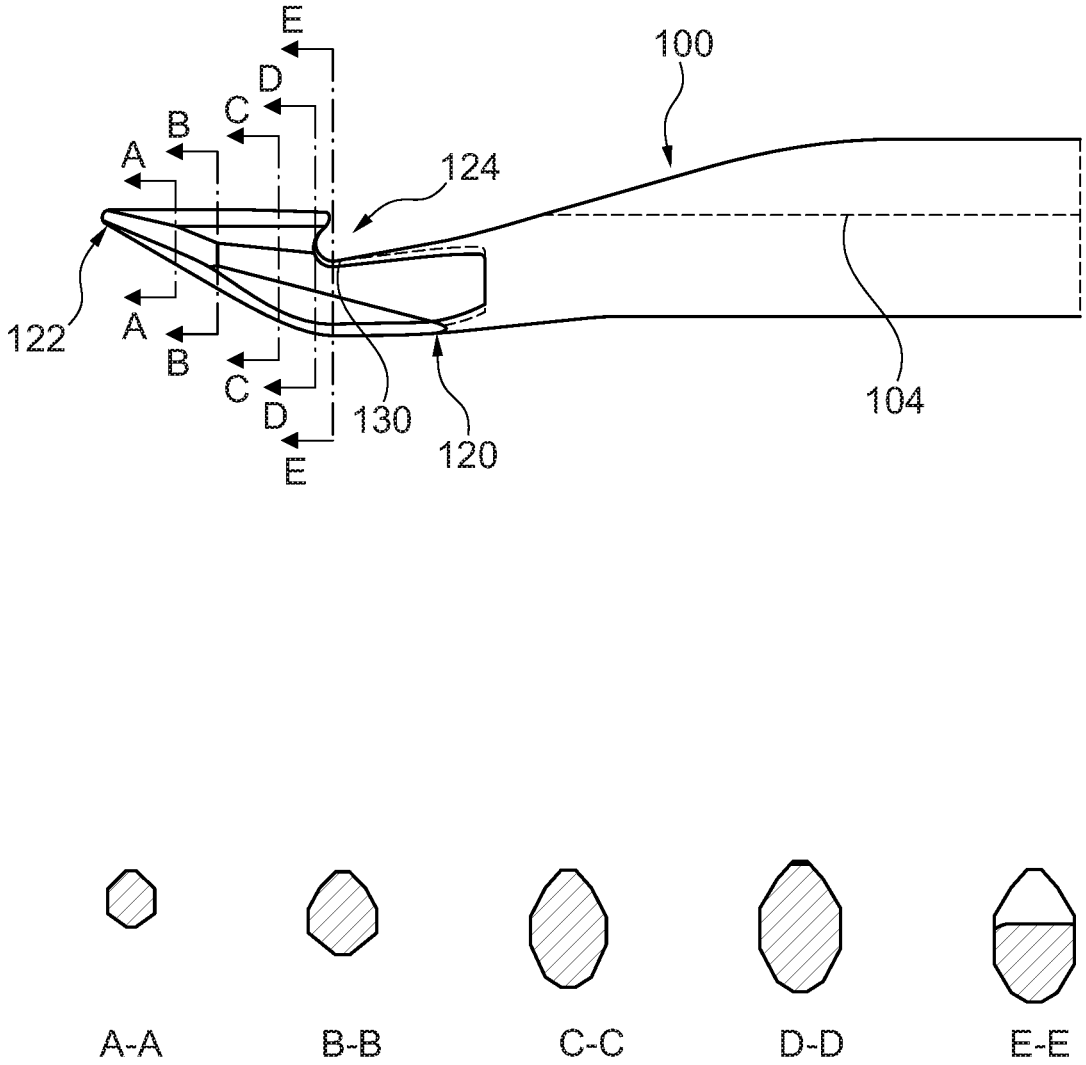
FIG. 4 is a side view and cross sections of a knitting needle comprising a hook point and having an approximately oval cross section at the hook point, along the lines denoted A-A, B-B, C-C, D-D and E-E in FIG. 4.

The knitting needle 100 has an approximately elliptical cross section at the hook point 102. FIG. 3 is a cross section of the knitting needle 100, in a plane in parallel with the vertical axis 106 and with the transverse axis 108, at the hook base 130. FIG. 4 is a side view and cross sectional views of the knitting needle 100, along the lines denoted A-A, B-B, C-C, D-D and E-E in FIG. 4, from which it is possible to identify the cross section at the corresponding positions.

The elliptical cross section is clearly visible in the cross-sectional views, at the positions C-C and D-D. Towards the point portion 122, the cross section reduces more significantly in the vertical direction than in the transverse direction. At the hook portion 124, the cross section is delimited at the front by the hook base 130 and is semi-elliptical in shape.

The cross section is in the shape of an elongated obtuse-angled polygon, in the present case hendecahedral or dodecahedral. Over a longitudinal portion of the knitting needle 100, the corners of the cross section form edges which extend in parallel with the longitudinal axis 104, on the upper side, and downwards towards the hook portion 124, to the rear portion 120, proceeding from the point portion 122, on the rear portion side.

The knitting needle 100 comprises a planar cover surface 134 on the upper face 114 of the hook point 102, which cover surface extends along the longitudinal axis 104, oblique first edge surfaces, such as 136, which adjoin the cover surface 134, and oblique second edge surfaces, such as 138, which adjoin the first edge surfaces 136. The first edge surfaces 136 enclose an angle $\alpha 1$ of approximately 90 degrees. The second edge surfaces 138 enclose an angle $\alpha 2$ of approximately 60 degrees. The edge surfaces 136, 138 are arranged so as to be symmetrical to the vertical axis.

At the rear portion 120 of the hook point 102, the knitting needle 100 comprises first edge surfaces, such as 140, which directly adjoin one another, and oblique second edge surfaces, such as 142, which adjoin the first edge surfaces 140. The first edge surfaces 140 enclose an angle $\alpha 3$ of approximately 120 degrees at the rear portion 120. The second edge surfaces 142 enclose an angle $\alpha 4$ of approximately 60 degrees at the rear portion 120.

The upper edge surfaces 136, 138 include a portion having a height H1 of approximately 30 percent of an overall height HO of the knitting needle 100. The lateral potions 116, 118 include a portion having a height H2 of approximately 30 percent of the overall height HO of the knitting needle 100. The edge portions 140, 142 on the rear portion side include a portion having a height H3 of approximately 30 percent of the overall height of the knitting needle 100.

As is clear in the plan view according to FIG. 2, the lateral portions 116, 118 converge at the point portion 122 in the manner of a step wedge, comprising a first step 144 and a second step 146. After the first step 144, the lateral portions 116, 118 converge at an angle $\alpha 5$ of approximately 7 degrees. After the second step 146, the lateral portions 116, 118 converge at an angle $\alpha 6$ of approximately 25 degrees.

Figure 5:
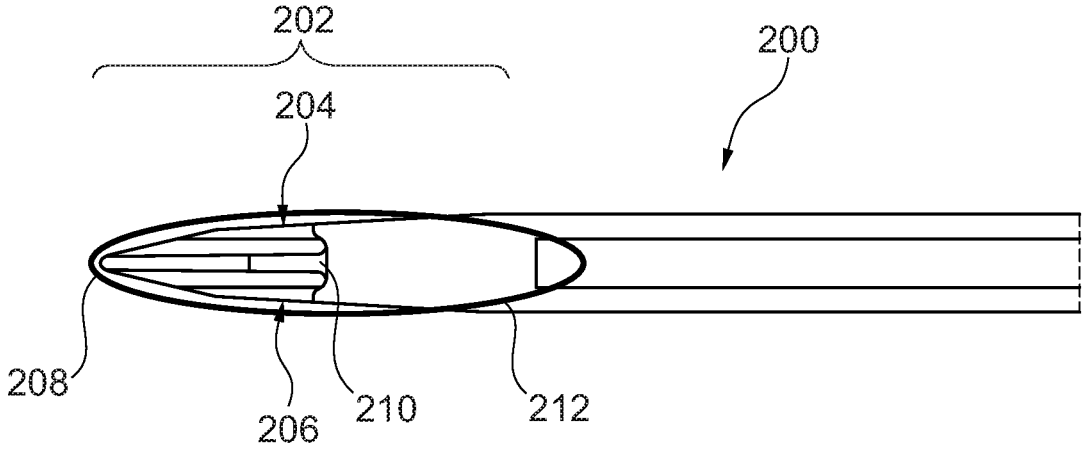
FIG. 5 is a plan view of a knitting needle comprising a hook point and converging lateral portions.

FIG. 5 is a plan view of a knitting needle 200 comprising a hook point 202 and converging lateral portions 204, 206. The lateral portions 204, 206 of the knitting needle 200 converge at the point portion 208, such that a polygonal elliptical shape 212 results in plan view. Furthermore, reference is made in addition in particular to FIG. 1 to FIG. 4, and the associated description.

Figure 6:
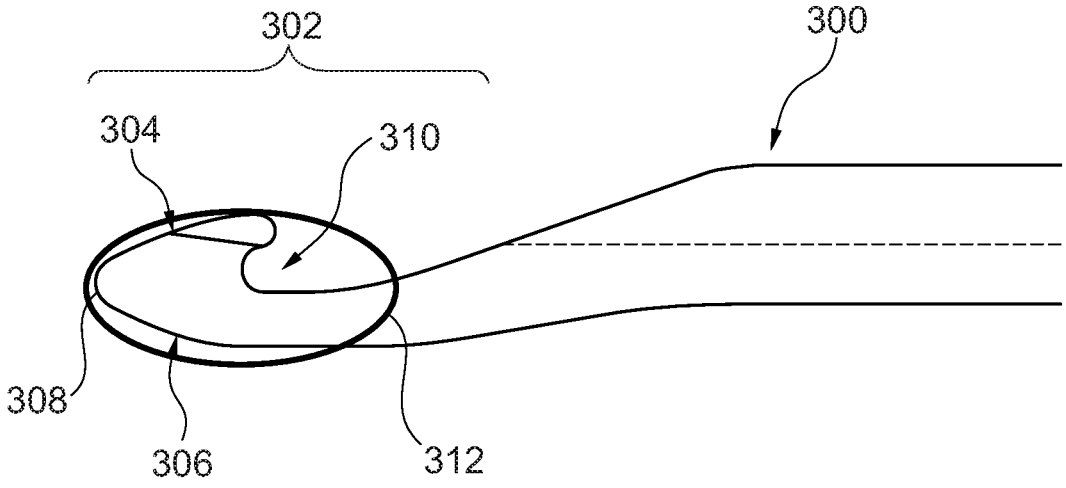
FIG. 6 is a side view of a knitting needle comprising a hook point and a converging upper face and rear portion.

FIG. 6 is a side view of a knitting needle 300 comprising a hook point 302 and converging upper face 304 and rear portion 306. The upper face 304 and the rear portion 306 converge at the point portion 308, and optionally also at the hook portion 310, such that an elliptical shape 312 results in a side view. Furthermore, reference is made in addition in particular to FIG. 1 to FIG. 4, and the associated description.

The knitting needle 100, 200, 300 is intended for use in a stitch bonding method, in which during a vertical lifting movement in a knitting needle longitudinal direction, corresponding to an extension direction of the longitudinal axis, the needle 100, 200, 300 is additionally moved horizontally, in a production direction transversely to the knitting needle longitudinal direction.

Figure 7:
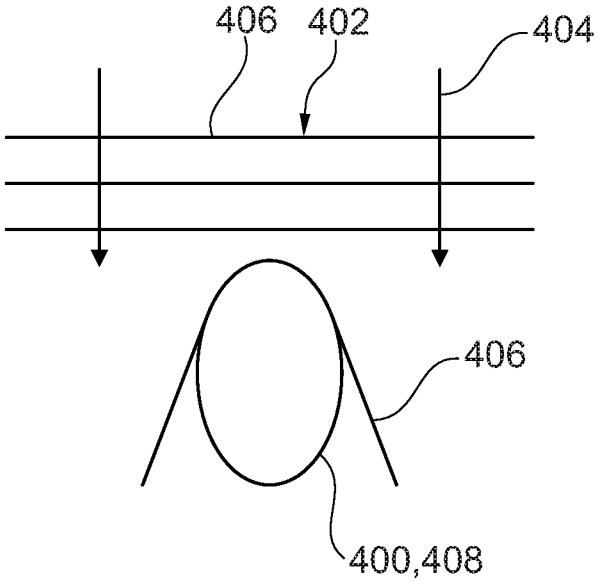
FIG. 7 shows a knitting needle comprising a hook point and having an approximately oval cross section at the hook point, when used together with a unidirectional non-woven fabric.
Figure 8:
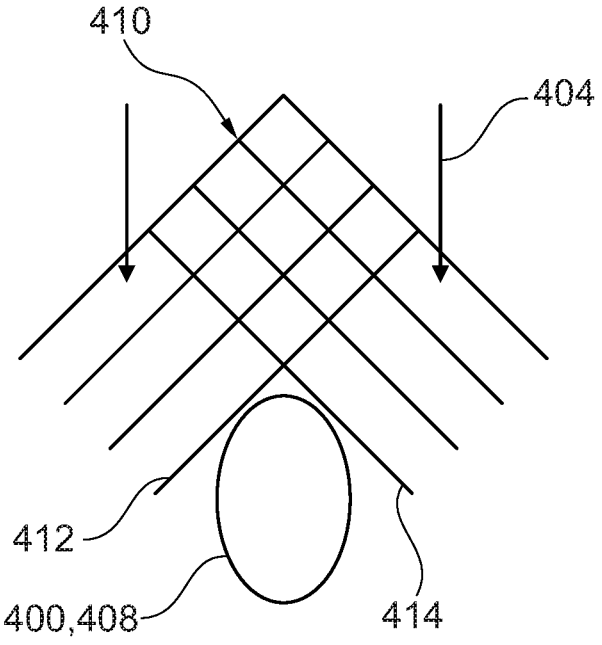
FIG. 8 shows a knitting needle comprising a hook point and having an approximately oval cross section at the hook point, when used together with a biaxial non-woven fabric.

FIG. 7 shows a knitting needle 400, like the knitting needles 100, 200, 300, when used together with a unidirectional non-woven fabric 402. The non-woven fabric 402 comprises fibers, such as 406, which extend at an angle of 90 degrees to a feed direction 404. FIG. 8 shows the knitting needle 400 when used together with a biaxial non-woven fabric 410. The non-woven fabric 410 comprises fibers, such as 412, 414, which extend at an angle of 90 degrees relative to one another, and at an angle of 45 degrees relative to the feed direction 404.

Owing to the elliptical cross section of the knitting needle 400, the fibers 406 or 412, 414 of the non-woven fabric 402 and 410, respectively, loop around the hook point 408 in an extensive manner, without significant deflection, such that wear on the knitting needle 400 and damage to the non-woven fabric 402 or 410 is reduced.

The knitting needle 400 can also be used together with a multiaxial non-woven fabric. The advantageous effects can come into their own in particular in this case.

"Can"/"may" refers in particular to optional features of the invention. Accordingly, there are also developments and/or embodiments of the invention which additionally or alternatively comprise the particular feature or the particular features.

While the present invention has been illustrated by a description of various embodiments, and while these embodiments have been described in considerable detail, it is not intended to restrict or in any way limit the scope of the appended claims to such detail. The various features shown and described herein may be used alone or in any combination. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit and scope of the general inventive concept.

LIST OF REFERENCE SIGNS

100 Knitting needle
102 Hook point
104 Longitudinal axis
106 Vertical axis
108 Transverse axis
112 Needle shank
114 Upper face
116 Lateral portion
118 Lateral portion
120 Rear portion
122 Point portion
124 Hook portion
126 Hook protrusion
128 Hook throat
130 Hook base
132 Slit
134 Cover surface
136 First edge surface

138 Second edge surface
140 First edge surface
142 Second edge surface
144 First step
146 Second step
200 Knitting needle
202 Hook point
204 Lateral portion
206 Lateral portion
208 Point portion
210 Hook protrusion
212 Elliptical shape
300 Knitting needle
302 Hook point
304 Upper face
306 Rear portion
308 Point portion
310 Hook portion
312 Elliptical shape
400 Knitting needle
402 Unidirectional non-woven fabric
404 Feed direction
406 Fiber
408 Hook point
410 Biaxial non-woven fabric
412 Fiber
414 Fiber

What is claimed is:

1. A knitting needle, comprising:
a hook point opposite a shank of the needle;
the hook point having an upper face, a rear portion on a side opposite the upper face, and oppositely disposed lateral portions extending between the upper face and the rear portion;
a planar cover surface at the upper face, the planar cover surface parallel to and extending along a longitudinal axis of the knitting needle;
the rear portion angled toward the longitudinal axis and converging with the planar cover surface at the longitudinal axis to define a point portion at a distal end of the hook point;
a hook protrusion opposite the point portion in a direction toward the shank; and
a hook throat extending from the hook protrusion in a direction toward the rear portion and terminating in a hook base;
the knitting needle having an elongated, obtuse-angled polygon cross-sectional shape, at least at a section delimited by the hook throat of the hook point.

2. The knitting needle of claim 1, further comprising:
oblique edge surfaces at the upper face of the hook point.

3. The knitting needle of claim 1, further comprising:
first oblique edge surfaces which adjoin the cover surface, and second oblique edge surfaces which adjoin the first edge surfaces.

4. The knitting needle of claim 3, wherein:
the first edge surfaces enclose an angle of from approximately 80 degrees to approximately 100 degrees at the upper face; and
the second edge surfaces enclose an angle of from approximately 50 degrees to approximately 70 degrees at the upper face.

5. The knitting needle of claim 4, wherein at least one of:
the first edge surfaces enclose an angle of approximately 90 degrees at the upper face; or
the second edge surfaces enclose an angle of approximately 60 degrees at the upper face.

6. The knitting needle of claim 1, further comprising oblique edge surfaces at the rear portion of the hook point.

7. The knitting needle of claim 1, further comprising:
oblique first edge surfaces at the rear portion of the hook point; and
oblique second edge surfaces which adjoin the first edge surfaces.

8. The knitting needle of claim 7, wherein:
the first edge surfaces enclose an angle of from approximately 110 degrees to approximately 130 degrees at the rear portion; and
the second edge surfaces enclose an angle of from approximately 50 degrees to approximately 70 degrees at the rear portion.

9. The knitting needle of claim 8, wherein at least one of:
the first edge surfaces enclose an angle of approximately 120 degrees at the rear portion; and
the second edge surfaces enclose an angle of approximately 60 degrees at the rear portion.

10. The knitting needle of claim 1, wherein:
the knitting needle further comprises:
oblique edge surfaces at the upper face of the hook point,
oblique edge surfaces at the rear portion of the hook point, and
lateral portions between the oblique edge surfaces at the upper face and the oblique edge surfaces at the rear portion;
the knitting needle has an overall height at the hook point;
the oblique edge surfaces at the upper face include a portion of from approximately 20 percent to approximately 40 percent of the overall height;
the lateral portions include a portion of from approximately 20 percent to approximately 40 percent of the overall height; and
the oblique edge surfaces at the rear portion include a portion of from approximately 20 percent to approximately 40 percent of the overall height.

11. The knitting needle of claim 10, wherein at least one of:
the upper edge surfaces include a portion of approximately 30 percent of the overall height of the knitting needle at the hook point;
the lateral portions include a portion of approximately 30 percent of the overall height; or
the edge surfaces on the rear portion side include a portion of approximately 30 percent of the overall height.

12. The knitting needle of claim 1, wherein:
lateral portions of the knitting needle converge at at least one of the point portion or the hook protrusion.

13. The knitting needle of claim 12, wherein the lateral portions of the knitting needle converge in the manner of a step wedge at least one of the point portion or the hook protrusion.

14. The knitting needle of claim 1, wherein:
the upper face and the rear portion converge at the point portion.

15. The knitting needle of claim 1, wherein:
the upper face extends along the longitudinal axis.

16. The knitting needle of claim 1, wherein:
the point portion is asymmetrical to the longitudinal axis.

* * * * *